US009272477B2

(12) United States Patent
Kasai

(10) Patent No.: US 9,272,477 B2
(45) Date of Patent: Mar. 1, 2016

(54) PRESSING TOOL AND LOCKING BOLT

(71) Applicant: IZUMI PRODUCTS COMPANY, Matsumoto, Nagano (JP)

(72) Inventor: Shin Kasai, Matsumoto (JP)

(73) Assignee: IZUMI PRODUCTS COMPANY, Nagano (JP)

( * ) Notice: Subject to any disclaimer, the term of this patent is extended or adjusted under 35 U.S.C. 154(b) by 0 days.

(21) Appl. No.: 14/380,135

(22) PCT Filed: Feb. 20, 2013

(86) PCT No.: PCT/JP2013/054165

§ 371 (c)(1),
(2) Date: Aug. 21, 2014

(87) PCT Pub. No.: WO2013/125575

PCT Pub. Date: Aug. 29, 2013

(65) Prior Publication Data

US 2015/0033817 A1 Feb. 5, 2015

(30) Foreign Application Priority Data

Feb. 21, 2012 (JP) ..... 2012-035276

(51) Int. Cl.

| | |
|---|---|
| ***B21D 37/14*** | (2006.01) |
| ***B30B 1/32*** | (2006.01) |
| ***B25B 27/10*** | (2006.01) |
| ***B21D 39/04*** | (2006.01) |
| ***H01R 43/042*** | (2006.01) |

(52) U.S. Cl.

CPC ..... *B30B 1/32* (2013.01); *B21D 39/048* (2013.01); *B25B 27/10* (2013.01); *H01R 43/042* (2013.01); *H01R 43/0428* (2013.01)

(58) Field of Classification Search

CPC .... B25B 27/10; B21D 39/048; H01R 43/042; H01R 43/0428; B30B 1/32

USPC ..... 72/453.16

See application file for complete search history.

(56) References Cited

U.S. PATENT DOCUMENTS

| | | | | |
|---|---|---|---|---|
| 2,923,180 | A * | 2/1960 | Dunn et al. | 408/68 |
| 4,911,726 | A * | 3/1990 | Warkentin | 81/176.15 |
| 5,169,168 | A * | 12/1992 | Harry et al. | 403/349 |
| 7,814,827 | B2 | 10/2010 | Frenken et al. | |

(Continued)

FOREIGN PATENT DOCUMENTS

| | | | |
|---|---|---|---|
| DE | 10110882 | A1 | 9/2002 |
| JP | 3-113768 | U | 11/1991 |

(Continued)

OTHER PUBLICATIONS

International Search Report for PCT/JP2013/054165 dated May 21, 2013. 2 pages in English.

*Primary Examiner* — David B Jones

(74) *Attorney, Agent, or Firm* — Sughrue Mion, PLLC

(57) ABSTRACT

A pressing tool in which, according to work content, an exchange tool is held so as to be capable of being exchanged by attachment/detachment by a locking bolt penetrating through a mounting portion provided to the tool main body, and the exchange tool is actuated by a pressing member. The outer periphery of the shank of the locking bolt is provided with: an annular groove for locking, arranged on the bolt-head side so as to be partially discontinuous; a release groove extending from the discontinuous part of the annular groove toward the tip of the bolt along the shank at an incline so as to gradually get shallower; and a retaining annular groove formed on the shank further toward the tip of the bolt than the release groove, the bolt-head side inner wall of the retaining annular groove being formed as a tapered incline. The mounting part is provided with a locking pin that fits into the locking annular groove, the release groove, and the retaining groove and that is capable of moving between the grooves. The locking bolt is provided with a release coil spring for urging the bolt toward the bolt head.

6 Claims, 7 Drawing Sheets

(56) References Cited

U.S. PATENT DOCUMENTS

| | | | | |
|---|---|---|---|---|
| 2005/0011236 | A1* | 1/2005 | Frenken et al. | 70/1 |
| 2008/0216543 | A1 | 9/2008 | Hamm et al. | |

FOREIGN PATENT DOCUMENTS

| | | | |
|---|---|---|---|
| JP | 2000-130419 | A | 5/2000 |
| JP | 2008-521612 | A | 6/2008 |

* cited by examiner

PRESSING TOOL AND LOCKING BOLT

TECHNICAL FIELD

The present invention relates to a pressing tool in which an exchange tool is held so as to be capable of being exchanged by attachment/detachment by a locking bolt on a mounting portion provided on the tool main body, and the exchange tool is actuated by a pressing member which protrudes from a tool main body side toward the exchange tool. The present invention also relates to a locking bolt configured for attaching/detaching the exchange tool to/from the pressing tool.

BACKGROUND ART

There is publicly known a pressing tool used for fixing a crimp or solderless terminal to a wire cable. In this instance, when a cable diameter or the crimp terminal differs, a tool head (an exchange tool) must be replaced with a counterpart complying with appropriate specifications in some cases. Further, tools that process a target other than the crimp terminal, e.g., a tool used for cutting a wire, cable, a steel wire, and others are widely used, and a tool head (the exchange tool) must be replaced in each of these tools when a diameter of a processing target differs.

Here, although there are many kinds of application pressures, e.g., an application pressure generated by a manual lever or an application pressure based on an air pressure or a hydraulic pressure, a hydraulic type is convenient in order to produce a large pressure. A hydraulic type or a pneumatic type usually requires a hydraulic pump or a pneumatic pump separately from a work tool, and an entire apparatus enlarges. Therefore, there is a driver (an electric hydraulic type) that drives a hydraulic pump with the use of an electric motor provided to a tool itself and actuates a pressing tool by a generated hydraulic pressure.

Since this electric hydraulic type is relatively small and light in weight and can provide a large application pressure based on an oil pressure, it is used for a portable tool. In this case, there is one that has an exchange tool mounted in a bifurcated mounting portion protruding toward a tool main body side and fixes the exchange tool and the mounting portion by using a penetrating locking bolt.

A locking bolt (5) disclosed in Patent Document 1 is constituted of a shank having a circular cross section and a bolt head (13) provided at one end thereof, and a securing recess 10, a longitudinal groove 11 extending in a longitudinal direction of the shank, and a blocking surface 18 that separates the longitudinal groove 11 from the securing recess 10 are formed on the shank. A depth of the securing recess 10 is equal to at least a depth of the longitudinal groove 11.

A securing element captivity is provided to one fork leg 2 of fork legs 2, 3 provided to the tool main body in a bifurcated manner. A securing element 7 held here is held on the securing element captive in a state that it is engaged with one of the longitudinal groove 11 and the securing recess 10 by constant engagement. The locking bolt 5 is movable in a bolt receptacle 4, which is a through hole provided in the fork leg 2, in the range between a lock position and a release position. A compression spring 15 is compressed and disposed between the fork leg 2 and the bolt head and energizes the locking bolt 5 toward the release position.

At the time of the locking the locking bolt 5, the securing element 7 engages with the securing recess 10. The securing recess 10 is formed on a surface of the locking bolt 5. To move the locking bolt 5 to the release position, the securing pin 7 is moved to the longitudinal groove 11. At the time of starting movement of the locking bolt 5, the securing pin 7 fixed in the securing recess 10 is guided by the longitudinal groove 11. Here, an end of the longitudinal groove 11 is terminated at a position away from a free end 12 of the locking bolt 5. As a result, the longitudinal groove 11 forms a stop at an unlock position (the release position) in cooperation with the securing pin 7. Consequently, the locking bolt 5 is held in a receiving neck 1 of the tool (Patent Document 1, Col. 6, Lines 54-67).

According to the invention disclosed in the Patent Document 1 as described above, at the time of releasing the locking bolt 5, the securing pin 7 is brought into contact with and held at the end of the longitudinal groove 11 (an end of the bolt on the free end side), and hence it serves as a retainer of the bolt.

Patent Document 2 is adopted as a prior art in the Patent Document 1. According to the Patent Document 2, a cylindrical security sector 17 energized toward a push-in side is provided at one end of a locking bolt 7, and a bevelled part 29 (a running-up slope) used for moving a locking pin 10 having a semispherical tip from an annular security sector 27 is formed on the cylindrical security sector 17 (see Patent Document 1, Column 1, Lines 33-61, "Background section"). That is, when the security sector 17 is pulled toward a pull side (an opposite side of the push-in side), the beveled part 29 of the security sector 17 pushes the locking pin 10 toward an outer side (a direction to push from the annular sector toward the outside) to effect unlocking, and the lock bolt 7 is released together with the security sector 17.

Here, an annular recessed part 33 is provided at an outer periphery of the other end (a free end side) of the bolt 7, and the locking pin 10 is engageably inserted into this part to serve as a retainer of the bolt. A side surface of the recessed part 33 on the security sector 27 side is formed as a bevelled part 34, and the locking pin 10 automatically moves out of the recessed part 33 at the time of pushing in the bolt 7 for locking. It is described that the invention in Patent Document 1 is configured to simplify handling with respect to Patent Document 2 as the prior art (Patent Document 1, Column 1, Lines 57-61).

PRIOR ART DOCUMENTS

Patent Documents

Patent Document 1: U.S. Pat. No. 7,814,827
Patent Document 2: DE 10110882A

SUMMARY OF THE INVENTION

Problems to be solved by the Invention

According to the Patent Document 1, although the longitudinal groove 11 is formed on the shank of the bolt 5, the securing element 7 can move only in the range between the longitudinal groove 11 and the securing recess 10, and hence the bolt 5 can turn in the circumferential direction only in the range of the securing recess 10 at the lock position and only within the width of the longitudinal groove 11 at the release position in each of the through holes (the bolt receptacles 4, 4) of the fork legs 2, 3.

Therefore, at the lock position of the bolt 5, a fixing position of the bolt 5 relative to the exchange tool is always substantially the same. Thus, a wear or abrasive surface of the bolt 5 is limited, and a problem that durability of the bolt 5 is restricted arises. Further, although a small amount of lubricant oil is usually supplied between the bolt 5 and the each through hole in advance, since the bolt 5 does not rotate, uniformly supplying the oil to the outer peripheral surface of the bolt 5 is difficult.

According to the Patent Document 2, the security sector must be assembled to the bolt head side, the structure is complicated, the security sector must be pulled out in case of setting the bolt to the release position, and hence the operation is troublesome.

In view of the above-described circumstance, it is a first object of the present invention to provide a pressing tool that can change a wearing or abrasive position of a locking bolt by enabling the bolt to turn with respect to a through hole provided in a mounting portion on a tool main body side, improve durability of the bolt, facilitate supply of a lubricant oil, reduce the number of components to provide a simple structure, and simplify operations. Furthermore, it is a second object of the present invention to provide a locking bolt for use in the pressing tool.

Means for Solving the Problems

According to the present invention, the first object is achieved by a pressing tool which holds an exchange tool to be detachable/replaceable by a locking bolt penetrating through a mounting portion provided to a tool main body in accordance with work contents, and actuates the exchange tool by a pressing member protruding from the tool main body side toward the exchange tool, wherein the locking bolt comprises, on a shank outer periphery of a shank of the locking bolt: a locking annular groove which is provided on a bolt head side and partially discontinuous; a release groove extending from the non-continuous part of the annular groove toward the tip of the bolt along the shank at an incline so as to gradually get shallower; and a retaining annular groove formed on the bolt tip side of the shank away from the release grove, the bolt-head side inner wall of the retaining annular groove being formed as a tapered incline;

wherein the mounting portion comprises a locking pin which is engageably inserted into the locking annular groove, the release groove, and the retaining annular groove of the locking bolt, and which is capable of moving between these grooves; and wherein the locking bolt comprises a release coil spring which is compressed and disposed between the bolt head and the mounting portion and which urges the locking bolt toward bolt head.

Moreover, the second object is achieved by a locking bolt for use in the pressing tool according to claim 1, the locking bolt comprising: a bolt head provided at one end of a shank of the locking bolt; a locking annular groove which is provided on the bolt head side and partially discontinuous; a release groove extending from the discontinuous portion of the annular groove toward the tip of the bolt along the shank at an incline so as to gradually get shallower; and a retaining annular groove formed on the shank further toward the tip of the bolt than the release groove, the bolt-head side inner wall of the retaining annular groove being formed as a tapered incline.

EFFECT OF THE INVENTION

According to the present invention, at the lock position where the locking pin (a latch pin) is engageably inserted in the locking annular groove on the bolt head side, the bolt can turn in the range of this annular groove, and a position where a pressure is applied to the bolt at the time of an operation of the exchange tool can be changed by varying the turning position of the bolt. Therefore, the durability of the bolt can be improved by changing a wear or abrasive surface of the bolt. Additionally, the supply of the lubricant oil to the bolt outer periphery can be facilitated. Further, the number of the components is small, the structure is simple, and the lock and release operations of the bolt are easy. According to the second invention, the locking bolt for use in this pressing tool can be provided.

BRIEF DESCRIPTION OF THE DRAWINGS

FIG. 4(A) shows a side elevation and FIG. 4(B) shows a front view;

FIG. 5(A) is a side elevation showing start of releasing, FIG. 5(B) is a side elevation showing the start of releasing, and FIG. 5(C) is a side elevation showing end of releasing;

FIG. 7(A) is a front view, FIG. 7(B) is a cross-sectional view taken along a line B-B in FIG. 7(A), FIG. 7(C) is a view seen from an arrow (C) of FIG. 7(B), and FIG. 7(D) is a cross-sectional view taken along a line D-D in FIG. 7(A).

MODE FOR CARRYING OUT THE INVENTION

A pressing tool used here can adopt various kinds of drive sources, e.g., a manual type, a hydraulic type, a pneumatic type, or an electric type. However, an electric hydraulic type that drives a hydraulic pump by an electric motor and presses the pressing tool by this hydraulic pressure is small in size, can provide large pressing force, and is suitable for a portable tool. A pressing member is not restricted to one that presses the pressing tool in a protruding direction, and it includes, e.g., one that presses in a rotating direction.

A plurality of discontinuous portions can be provided on a locking annular groove provided on a bolt head side of a locking bolt, a plurality of release grooves extending from the respective discontinuous portions on one side thereof along a shank can be provided, an amount of rotation of the bolt required at the time of releasing the bolt from a lock position can be reduced in this case, and a release operation can be further facilitated.

When a resistance imparting portion that a locking pin gets or climbs over in case of moving from the locking annular groove to each release groove is formed on the locking annular groove in advance, the locking pin can be prevented from moving to each release groove from the annular groove against a user's will. The resistance imparting portion can be provided on a sidewall of the locking annular groove on a bolt tip side, but it may be provided on a bottom of the locking annular groove to impart resistance by forward/backward movement that imparts sliding resistance to the locking pin.

The resistance imparting portion may be a convex portion provided on an inner angle side of a bent portion where the locking annular groove joins each release groove. In this case, when the locking pin moves from the locking annular groove to each release groove, the locking pin gets over the convex portion to thereby impart the resistance. That is, since a release coil spring imparts restoring behavior in a bolt head direction to the locking bolt, the locking pin imparts the resistance to revolving of the locking bolt when the locking pin gets over the convex portion against restoring force of the release coil spring, thereby preventing the locking pin from entering each release grooves from the annular groove against a user's will.

EMBODIMENT 1

Figure 1:
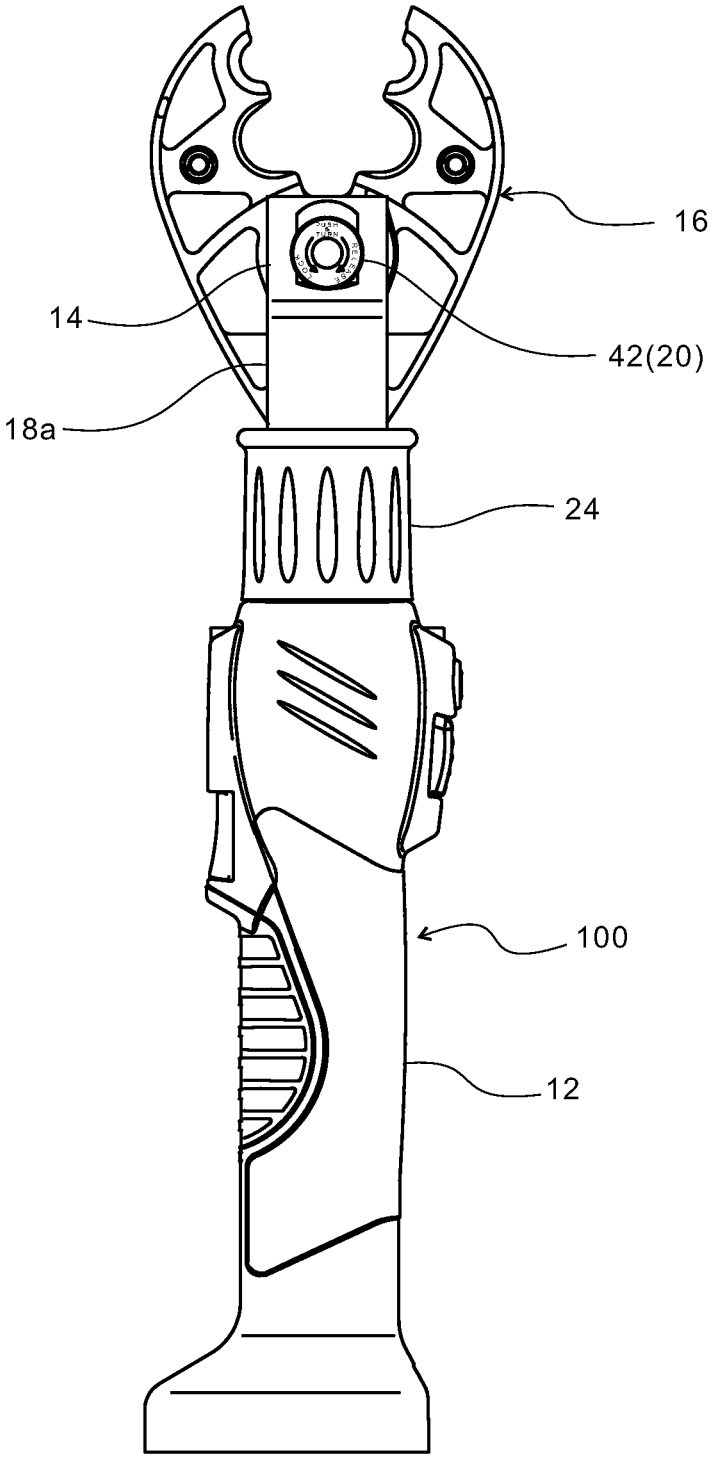
FIG. 1 is a front view showing an appearance of a terminal crimp tool that is an embodiment according to the present invention.
Figure 2:
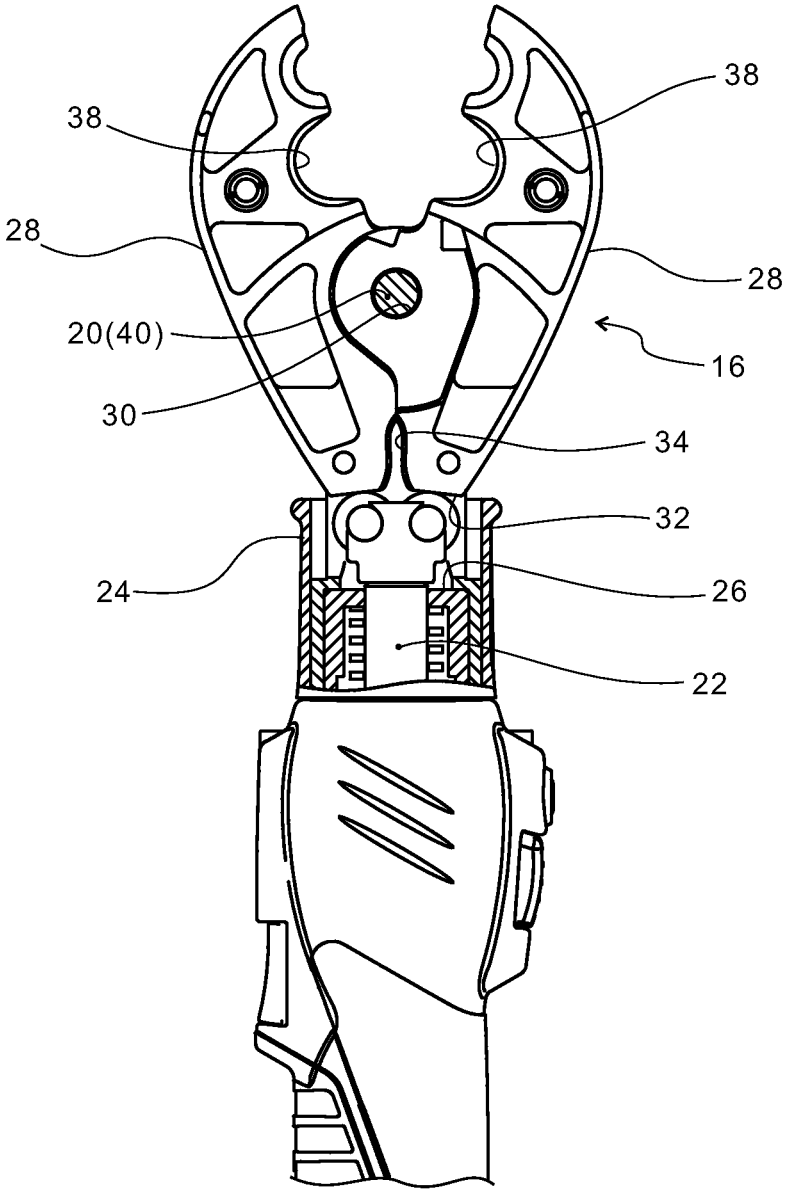
FIG. 2 is a partial cross-sectional view showing when the tool in FIG. 1 is not pressing.
Figure 3:
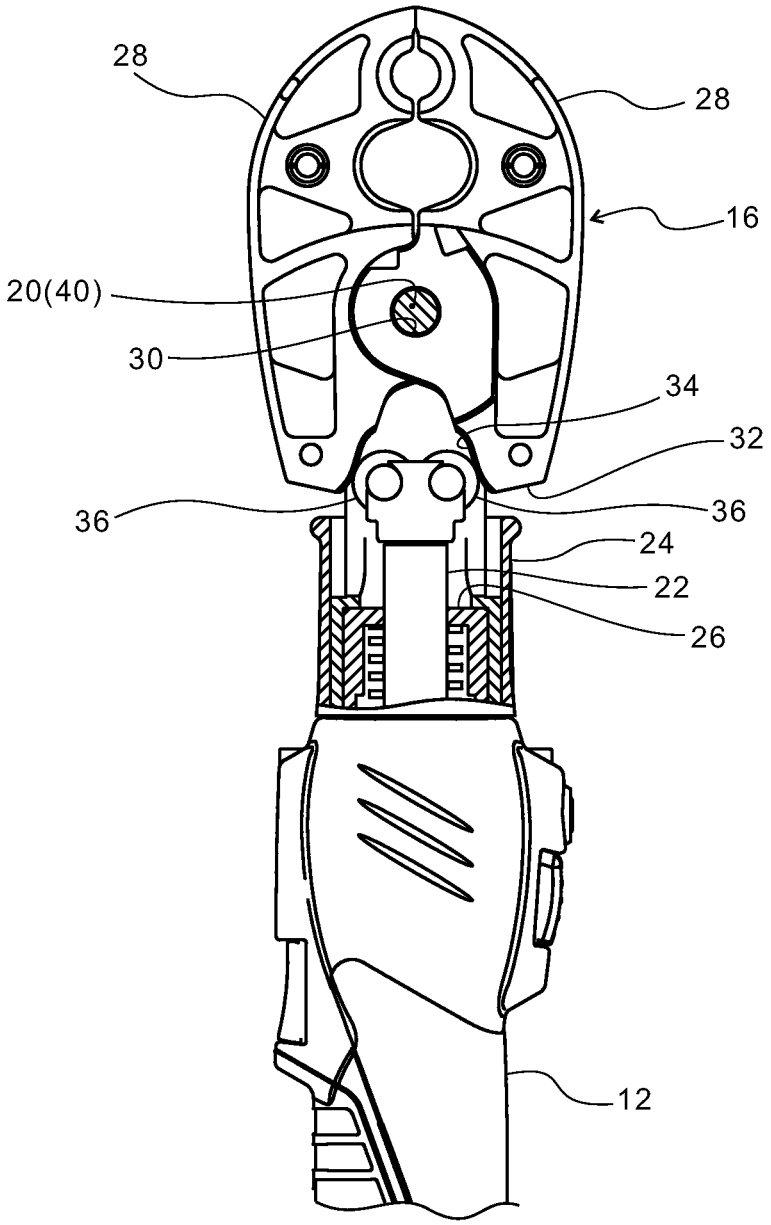
FIG. 3 is a partial cross-sectional view showing a pressing operation of the tool in FIG. 1.

A pressing tool 100 shown in FIGS. 1 to 3 is a crimp tool used for pressing a crimp or solderless terminal at a cable end or the like. The crimp tool (a pressing tool) 100 has a grippable rod-like main body 12 that can be gripped, a mounting portion 14 fixed at a tip of the main body 12, and an exchange tool 16 attached to the mounting portion 14.

Figure 4:
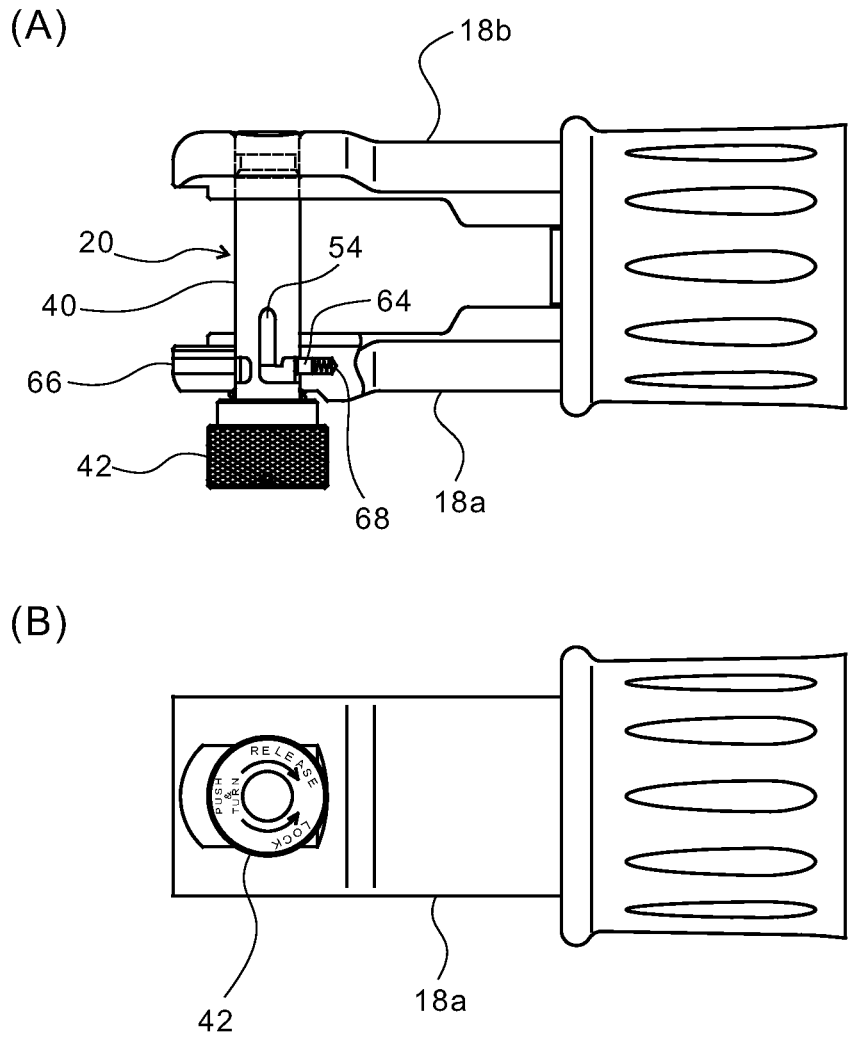
FIG. 4 are views showing when an attachable/detachable portion of the tool in FIG. 1 in which an exchange tool is omitted is locked, where

The mounting portion 14 includes a pair of front and rear legs 18 (18*a*, 18*b*) extending parallel to a tip direction of the main body 12 to interpose a gap therebetween (FIG. 4(A)). The pressing exchange tool 16 can be attached/detached between these legs 18 by a locking bolt 20 described herein after. That is, the locking bolt 20 is movable between a lock position (FIG. 4) where the locking bolt 20 penetrates through the legs 18*a*, 18*b* and the exchange tool 16 so as to fix the exchange tool 16 and a release position (FIG. 5) where the locking bolt 20 moves out of one leg 18*b* (a rear side) and the exchange tool 16 and is held by the other leg 18*a* (a front side).

In the tool main body 12 are incorporated a rechargeable battery, an electric motor, a hydraulic pump driven by the electric motor, a control circuit (all of them are not shown), and a pressing member 22 (FIGS. 2 and 3) which is driven in a protruding direction by a hydraulic pressure of the hydraulic pump. Here, a cylinder case 24 is fixed at an upper end of the main body 12, and a cylinder 26 accommodated here protrudes a piston rod upward from a space between the legs 18*a*, 18*b*. The piston rod acts as the pressing member 22.

The exchange tool 16 in this embodiment is a pressing tool for a crimp terminal, and it includes a pair of jaw members 28, 28 which can swing like a pair of scissors around the locking bolt 20. A through hole 30 for the locking bolt 20 is formed in each jaw member 28, and both the jaw members 28 are held to turn around the through holes 30. That is, both the jaw members 28 are energized and assembled by a coil spring (not shown) in such a manner that their lower portions move closer to each other.

At the time of releasing (non-pressing) shown in FIG. 2, a lower slope 32 and an upper slope 34 are formed on a lower portion of each jaw members 28. The lower slope 32 which descends toward the outer side and an upper slope 34 which extends upward to be continuous with the inner side of each lower slope 32. A pair of rollers 36, 36 which roll on the lower slope 32 and the upper slope 34 are disposed to the upper end of the pressing member 22. Accordingly, the rollers 36, 36 expand the lower slopes 32, 32 outward as shown in FIG. 2 when the pressing member 22 moves up, and the rollers 36, 36 further expand the upper slopes 34 when the pressing member 22 further moves up.

Concave portions 38 which nip a crimp terminal are formed on upper opposed surfaces of the jaw members 28, 28, respectively. When the lower portions of the jaw members 28, 28 are expanded outward by the pressing member (piston rod) 22 as described above, the respective concave portions 38 move closer to each other, and the crimp terminal (not shown) nipped between these portions is pressed and crimped.

Figure 5:
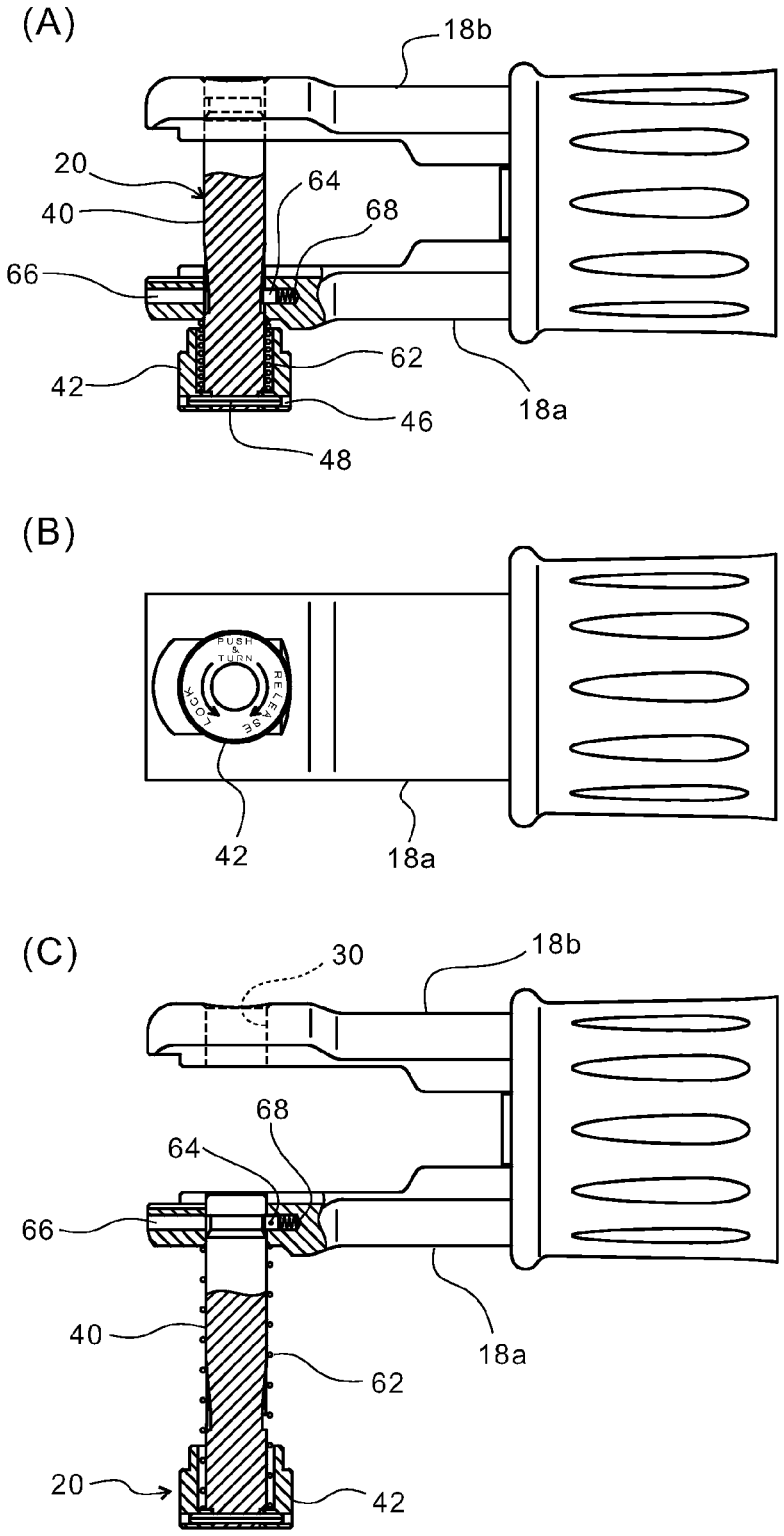
FIG. 5 are views showing a release status of the attachable/detachable portion of the tool in FIG. 1 in which the exchange tool is omitted, where
Figure 6:
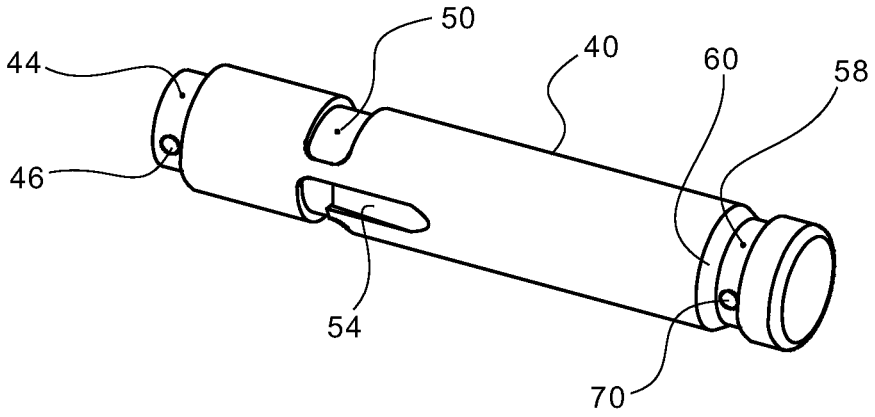
FIG. 6 is a perspective view of a locking bolt in FIG. 1.
Figure 7:
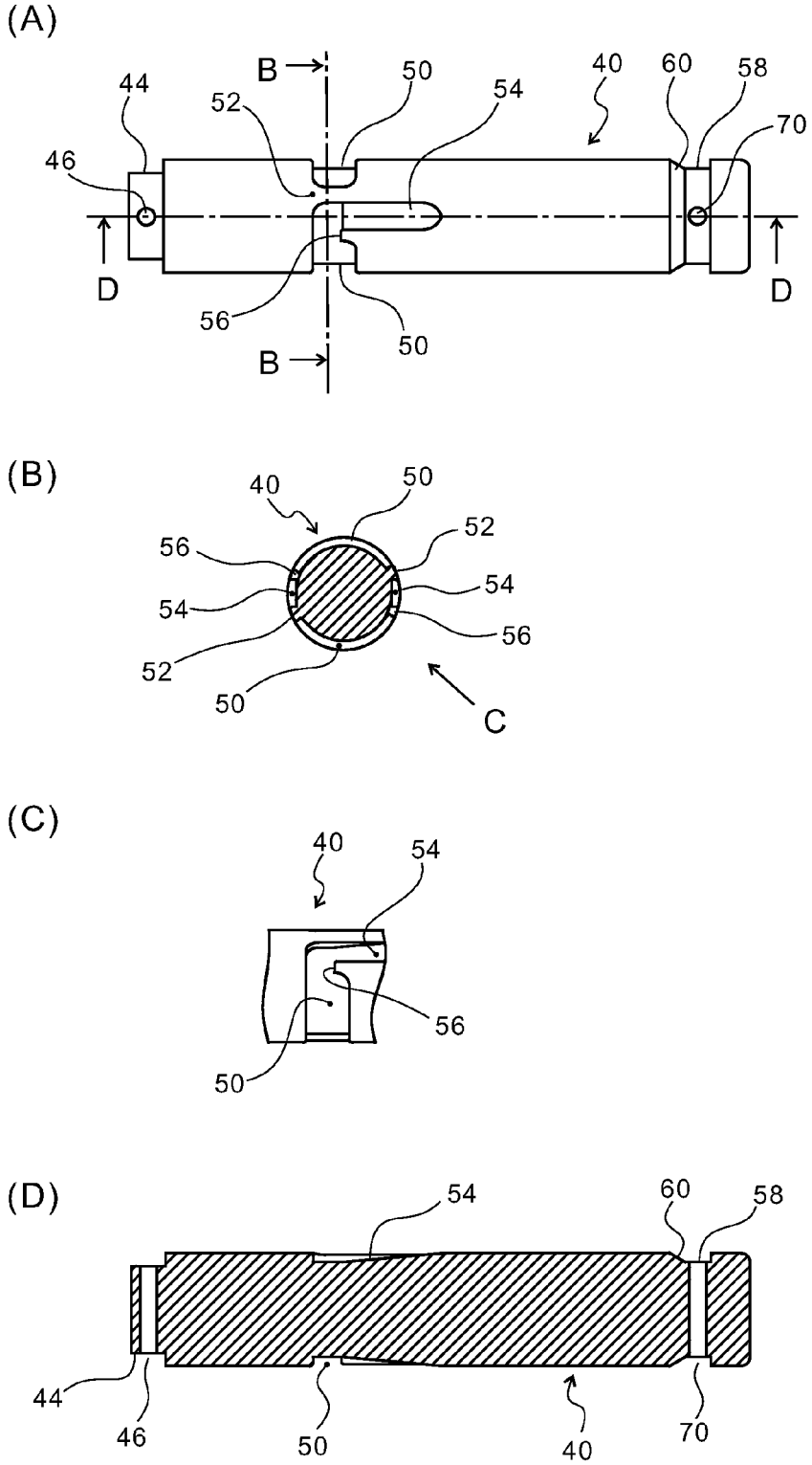
FIG. 7 are views showing particulars of the locking bolt in FIG. 6, where

The locking bolt 20 will now be described. As shown in FIGS. 4 and 5, the locking bolt 20 has a rod-like shank 40 and a bolt head 42 disposed to an end of the shank 40. As shown in FIGS. 6 and 7, an end portion outer periphery of one end of the shank 40 are machined or cut to form a cut portion 44 on which the bolt head 42 is disposed. As shown in FIGS. 4 and 5, the bolt head 42 is fitted on the cut portion 44, a pin 48 is press-fitted in a small hole 46 pierced in the bolt head 42 and the cut portion 44, and the bolt head 42 is fixed to the shank 40.

A pair of annular grooves 50 for locking are symmetrically formed on the outer periphery of the shank 40 on the bolt head 42 side (the cut portion 44 side). As shown in FIG. 7(B), these annular grooves 50 are symmetrically formed to interpose discontinuous portions 52, 52 which are formed at symmetric positions around a center axis of the shank 40. Release grooves 54, 54 extending toward the other end side (the bolt tip) of the shank 40 are continuously formed at symmetric positions around the center axis of the shank 40, i.e., corners of the respective annular grooves 50 in a circumferential direction.

A convex portion 56, which is convex on the bolt head 42 side from a bolt-tip-side sidewall of each annular groove 50, is formed on an inner angle side of a bent portion where each locking annular groove 50 joins each release groove 54, i.e., an angular portion connected to the release groove 54 from the bolt-tip-side sidewall of the annular groove 50 (FIG. 7(A)). The convex portion 56 serves as a resistance imparting portion according to the present invention.

A bottom of each of the release grooves 54, 54 forms a slope which becomes gradually shallow from the annular groove 50 toward the bolt tip side (FIG. 7(D)), and it forms a run-up slope which is continuous with an outer peripheral surface of the shank 40 from the middle of the shank 40. A retaining annular groove 58 is formed on the bolt tip side of the shank 40 apart from the release grove 54. An inner wall of the annular groove 58 on the bolt head 42 side forms a tapered slope 60.

A release coil spring 62 is attached to the locking bolt 20 from the tip side, and the locking bolt 20 is inserted into the through hole 30 of the front-side leg 18*a* from the front side. At this time, a locking pin 64 protruding toward an inner surface of the through hole 30 is engageably inserted into one of the annular grooves 50, 56 and the release grooves 54. As shown in FIG. 4(A) and FIGS. 5(A) and (C), a small hole 66 bored to cut across the through hole 30 from the tip of the leg 18*a* is loaded with the locking pin 64 together with a pin energizing coil spring 68, and the locking pin 64 is urged to protrude into the through hole 30. Here, a diameter of the locking pin 64 near the tip thereof is set so that the locking pin 64 can be engageably inserted into the position of the convex portion 56 of the annular groove 50 and each release groove 54.

When the locking bolt 20 is attached, one end of the release coil spring 62 is held in a gap between the shank 40 and the bolt head 42, the other end of the coil spring 62 is held on an outer surface on the leg 18*a* side, and restoring behavior in the front direction is imparted to the locking bolt 20. At this time, a thin rod (not shown) is inserted into a small hole 70 of the leg 18*a* from a tip thereof, and the shank 40 is inserted while pushing in the locking pin 64 through the small hole 70 opened in the retaining annular groove 58 of the shank 40. As a result, the locking pin 64 is engageably inserted in the retaining annular groove 58. This is a releasing state as shown in FIG. 5(C). It is to be noted that the small hole 70 has a diameter smaller than the locking pin 64 and the pin 64 does not enter the small hole 70.

The exchange tool 16 is set between the legs 18*a*, 18*b* of the mounting portion 14 from this state, the through hole 30 of the exchange tool 16 is positioned with respect to the through holes 30 of the legs 18, the locking bolt 20 is further pushed in while compressing the release coil spring 62, and then the locking pin 64 is pushed out from the annular groove 58 by the tapered slope 60 of the annular groove 58. Therefore, the locking pin 64 runs aground the outer peripheral surface of the shank 40. In this state, the locking bolt 20 can freely turn.

When the locking bolt 20 is further pushed in and rotated in a counterclockwise direction as shown in FIG. 4(B), the locking pin 64 is engageably inserted into the locking annular groove 50. At this time, when an angle position of the locking bolt is provided as an angle at which the locking pin 64 has been already engageably inserted in the annular groove 50, the locking bolt 20 does not have to be turned.

Movement of the locking bolt 20 in the release direction is restricted when the locking annular groove 50 is engaged with the locking pin 64 in this state. That is, the lock position shown in FIG. 4 is provided. In this state, the locking bolt 20 can turn until the locking pin 64 is brought into contact with the convex portion 56 of the annular groove 50. Thus, the locking bolt 20 can turn in this range even in the lock state.

At the time of exchanging the exchange tool 16, when the locking bolt 20 is pushed in and turned in a clockwise direction (a RELEASE direction) in FIG. 5(B) while avoiding interference between the locking pin 64 and the convex portion 56, the locking pin 64 climbs over the convex portion 56 and enters the release groove 54. When a finger is removed from the locking bolt 20 and released at this position, the locking bolt 20 is pushed back toward the front direction by the release coil spring 62.

Therefore, the locking pin 64 engaged with the release groove 54 is pushed up by the run-up slope of the bottom surface of the release groove 54, and the locking pin 64 moves out of the release groove 54 and comes into contact with the outer peripheral surface of the shank 40. Further, the locking pin 64 engages with the retaining annular groove 58 and returns to the release position shown in FIG. 5(C). In this state, since the locking bolt 20 moves out of the exchange tool 16, the exchange tool 16 can be exchanged.

DESCRIPTION OF REFERENCE NUMERALS

100 pressing tool
14 mounting portion
16 exchange tool
18 leg
20 locking bolt
22 pressing member (piston rod)
28 jaw member
30 through hole
40 shank
42 bolt head
50 locking annular groove
52 discontinuous portion
54 release groove
56 convex portion (resistance imparting portion)
58 retaining annular groove
60 slope
62 release coil spring
64 locking pin
68 pin urging coil spring

The invention claimed is:

1. A pressing tool configured to hold an exchange tool, said pressing tool comprising:
- a tool main body;
- a pressing member protruding from the tool main body towards the exchange tool, said pressing member configured to actuate the exchange tool;
- a mounting portion disposed on the tool main body;
- a locking bolt penetrating through the mounting portion to detachably hold the exchange tool,
- wherein the locking bolt comprises:
- a shank portion;
- a bolt head connected to the shank portion at a first end of the shank portion, and
- the shank portion having an outer periphery formed with
- a locking annular groove disposed towards the first end of the shank portion, wherein said locking annular groove has a non-continuous part;
- a release groove extending from the non-continuous part of the locking annular groove in a longitudinal direction along the shank portion in a direction away from the first end, said release groove gradually getting shallower in the longitudinal direction; and
- a retaining annular groove formed towards a second end of the shank portion and spaced from the release groove, wherein the second end is disposed on the opposite end of the shank portion from the first end, wherein the inner wall of the retaining annular groove is formed as a tapered incline;
- wherein the mounting portion comprises a locking pin which is engageably inserted into the locking annular groove, the release groove, and the retaining annular groove of the locking bolt, and said locking pin is movably disposed between the locking annular groove, the release groove, and the retaining groove.

2. The pressing tool according to claim 1, wherein the pressing tool is an electric hydraulic type which actuates the pressing member by a hydraulic pressure generated by an electric pump.

3. The pressing tool according to claim 1, wherein the locking annular groove further comprises at least a second non-continuous part and the shank portion further comprises at least a second release groove extending from the second non-continuous part along the shank portion in the longitudinal direction.

4. The pressing tool according to claim 1, wherein the locking annular groove is provided with a resistance imparting portion, and the locking pin is movably disposed over the resistance imparting portion when moving from the locking annular groove to the release groove.

5. The pressing tool according to claim 4, wherein the resistance imparting portion is a convex portion formed on the shank portion between the locking annual groove and the release groove, where the locking annual groove and the release groove meet at an angle, and wherein the locking pin is movably disposed over the convex part between the locking annular groove and the release groove.

6. A locking bolt configured to be used in a pressing tool, the locking bolt comprising:
- a shank portion;
- a bolt head provided at a first end of the shank portion;
- the shank portion having an outer periphery formed with a locking annular groove having a non-continuous part;
- a release groove extending from the non-continuous part of the locking annular groove along a longitudinal direction of the shank portion, said release groove having a depth that becomes shallower in the outer periphery of the shaft portion, the depth being larger at the non-continuous portion of the annular groove and inclined to become smaller in a direction away from the first end of the shaft portion; and a retaining annular groove, formed on the shank portion toward a second end of the shank portion, said second end being opposite the first end, the retaining annular groove being formed as a tapered incline, said retaining annular groove having a shallower depth on a side proximal to the first end than on the second end.

* * * * *